US010153123B2

(12) United States Patent
Katarki et al.

(10) Patent No.: US 10,153,123 B2
(45) Date of Patent: Dec. 11, 2018

(54) COMPACT DUAL ELEMENT FUSE UNIT, MODULE AND FUSIBLE DISCONNECT SWITCH

(71) Applicant: EATON INTELLIGENT POWER LIMITED, Dublin (IE)

(72) Inventors: Advait Madhusudan Katarki, Chesterfield, MO (US); Patrick Alexander von zur Muehlen, Wildwood, MO (US); Robert Stephen Douglass, Wildwood, MO (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/222,125

(22) Filed: Jul. 28, 2016

(65) Prior Publication Data

US 2016/0336137 A1 Nov. 17, 2016

Related U.S. Application Data

(62) Division of application No. 14/663,505, filed on Mar. 20, 2015, now Pat. No. 9,697,976.

(51) Int. Cl.

| | |
|---|---|
| ***H01H 85/00*** | (2006.01) |
| ***H01H 71/18*** | (2006.01) |
| ***H01H 85/165*** | (2006.01) |
| ***H01H 85/04*** | (2006.01) |
| ***H01H 85/12*** | (2006.01) |
| ***H01H 89/04*** | (2006.01) |
| ***H01H 85/17*** | (2006.01) |
| ***H01H 85/175*** | (2006.01) |
| ***H01H 85/36*** | (2006.01) |
| *H01H 85/10* | (2006.01) |
| *H01H 85/56* | (2006.01) |
| *H01H 37/76* | (2006.01) |

(52) U.S. Cl.

CPC ..... *H01H 85/12* (2013.01); *H01H 85/17* (2013.01); *H01H 85/175* (2013.01); *H01H 85/36* (2013.01); *H01H 89/04* (2013.01); *H01H 85/10* (2013.01); *H01H 85/56* (2013.01); *H01H 2037/762* (2013.01); *H01H 2235/01* (2013.01)

(58) Field of Classification Search

CPC .... H01H 69/02; H01H 85/143; H01H 85/175; H01H 85/47; H01H 85/12; H01H 85/17; H01H 85/36; H01H 85/10; H01H 85/56

USPC ..... 337/123, 293, 10, 341, 163, 257, 255, 337/256

See application file for complete search history.

(56) References Cited

U.S. PATENT DOCUMENTS 5,077,534 A * 12/1991 Douglass ..... H01H 85/055 337/164

5,252,942 A * 10/1993 Gurevich ..... H01H 85/055 337/159

(Continued)

*Primary Examiner* — Anthony Haughton

(74) *Attorney, Agent, or Firm* — Armstrong Teasdale LLP

(57) ABSTRACT

An embodiment of a fuse module has been disclosed. The fuse module includes a housing and a fuse element assembly contained within the housing. The fuse element assembly includes at least one fuse element unit having a plurality of trigger mechanisms and a perforated strip electrically connected to the trigger mechanisms. Increased ampacity ratings in a more compact arrangement provides for fuse modules having increased current protection capability that, in turn, provides for improved disconnect switching capabilities.

18 Claims, 10 Drawing Sheets

(56) References Cited

U.S. PATENT DOCUMENTS 5,841,337 A * 11/1998 Douglass ..... H01H 85/0452
337/159
6,194,989 B1 * 2/2001 Douglass ..... H01H 85/10
337/228

* cited by examiner

COMPACT DUAL ELEMENT FUSE UNIT, MODULE AND FUSIBLE DISCONNECT SWITCH

CROSS-REFERENCE TO RELATED APPLICATIONS

This application is a divisional application of U.S. patent application Ser. No. 14/663,505 filed on Mar. 20, 2015, the disclosure of which is hereby incorporated by reference in its entirety.

BACKGROUND

The field of the invention relates generally to electrical fuses and, more specifically, to time-delay fuses.

Fuses are widely used as overcurrent protection devices to prevent costly damage to electrical circuits. Fuse terminals typically form an electrical connection between an electrical power source or power supply and an electrical component or a combination of components arranged in an electrical circuit. One or more fusible links or elements, or a fuse element assembly, is connected between the fuse terminals, so that when electrical current flowing through the fuse exceeds a predetermined limit, the fusible elements melt and open one or more circuits through the fuse to prevent electrical component damage.

At least some known time-delay fuses utilize a dual-element configuration having an overcurrent protection element and a short-circuit protection element that are electrically connected together in series. However, known fuses of this type exhibit a one-to-one pairing of the different elements, with only one overcurrent protection element being provided for each short-circuit protection element. This one-to-one pairing scheme often results in a dual-element configuration that occupies an undesirable amount of space and, hence, causes an undesirable increase in the size of the fuse as a whole. It would be useful, therefore, to provide a more compact dual-element configuration for time-delay fuses, thereby enabling such fuses to be more versatile in their use and more cost-effective in their manufacture.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION

Exemplary embodiments of electrical fuses are described below. Method aspects will be in part apparent and in part explicitly discussed in the description.

Figure 1:
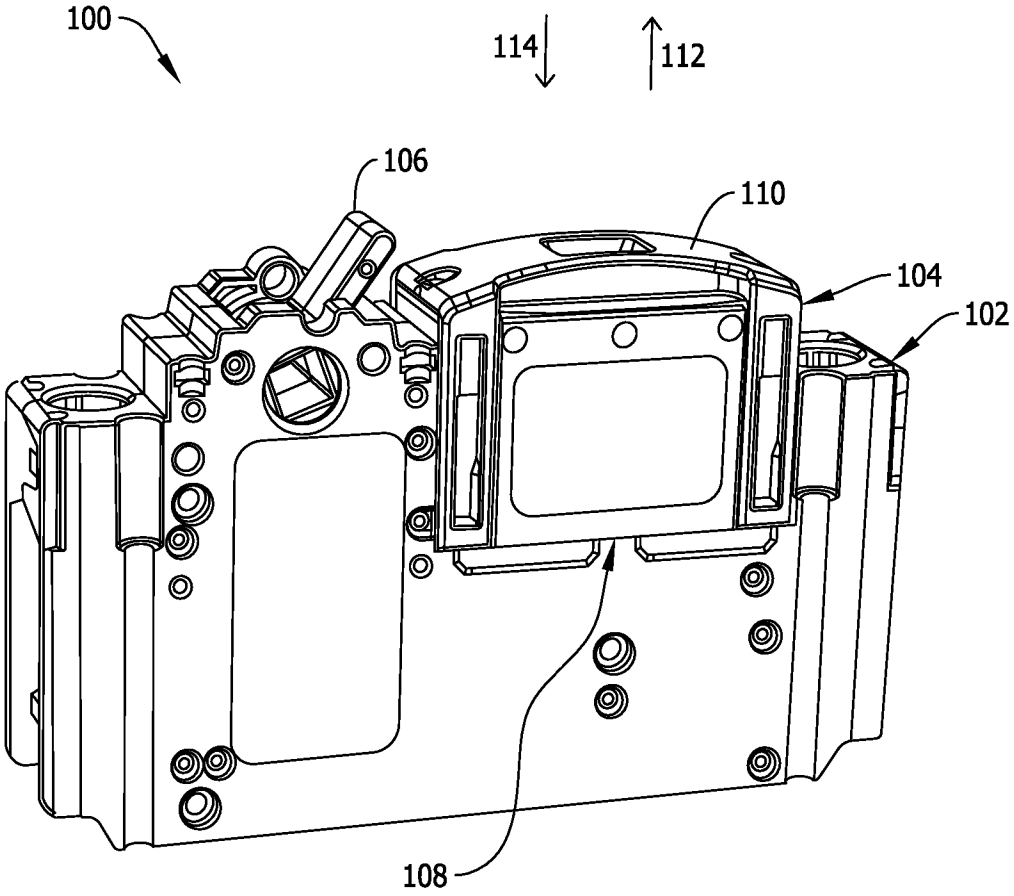
FIG. 1 is a perspective view of a fusible disconnect switch assembly.
Figure 2:
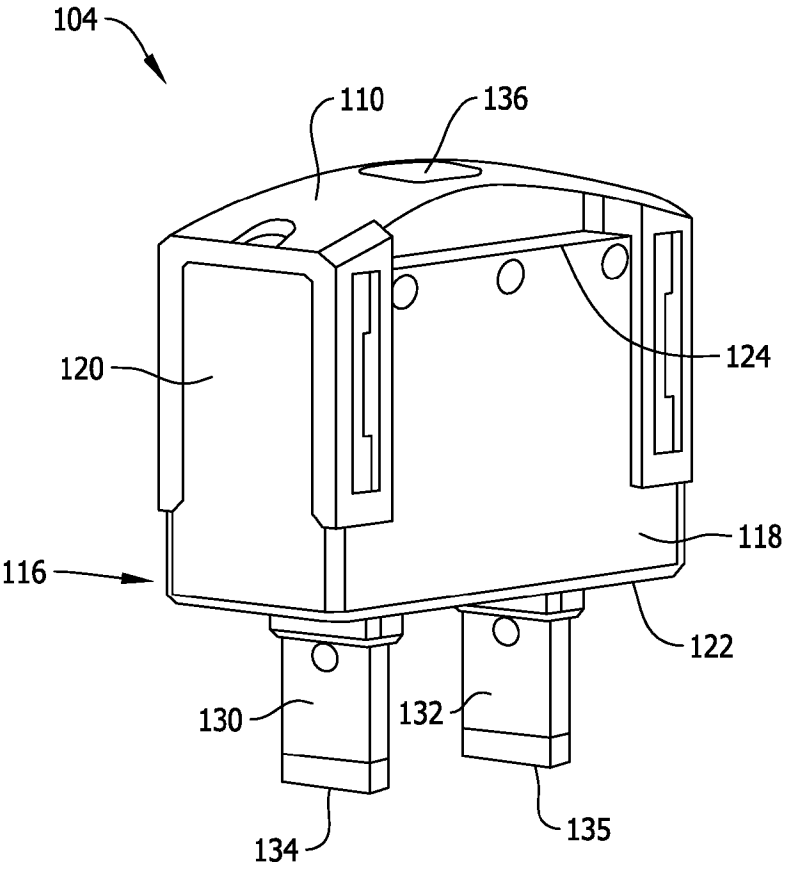
FIG. 2 is a perspective view of a fuse module of the switch assembly shown in FIG. 1.
Figure 3:
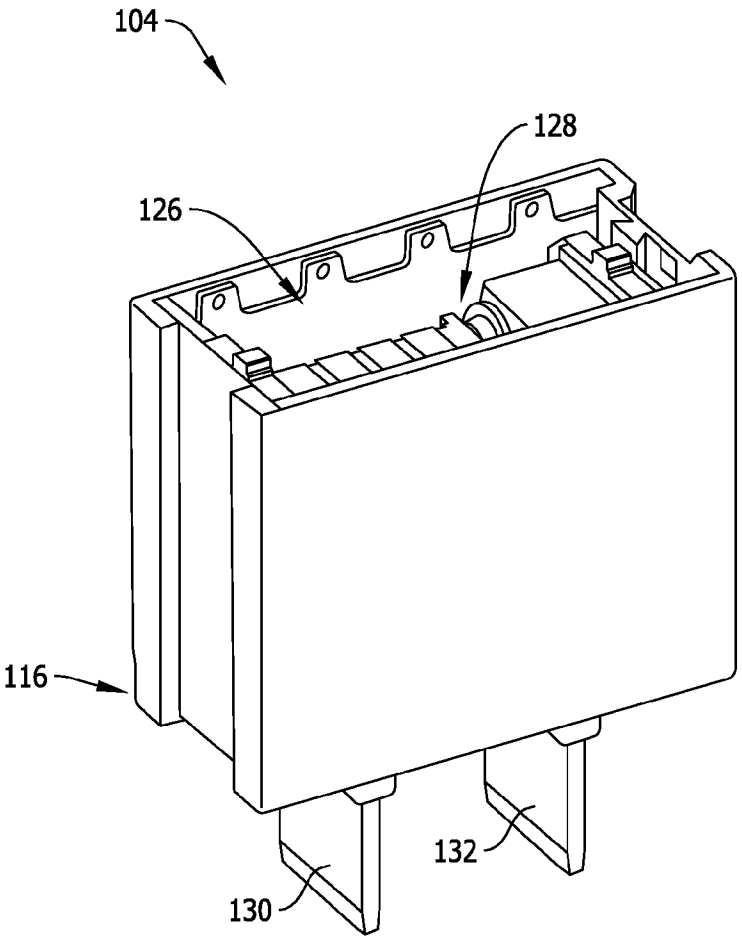
FIG. 3 is a perspective view of the fuse module shown in FIG. 2 with its housing top wall removed and its remaining housing walls made transparent for ease of illustration.
Figure 4:
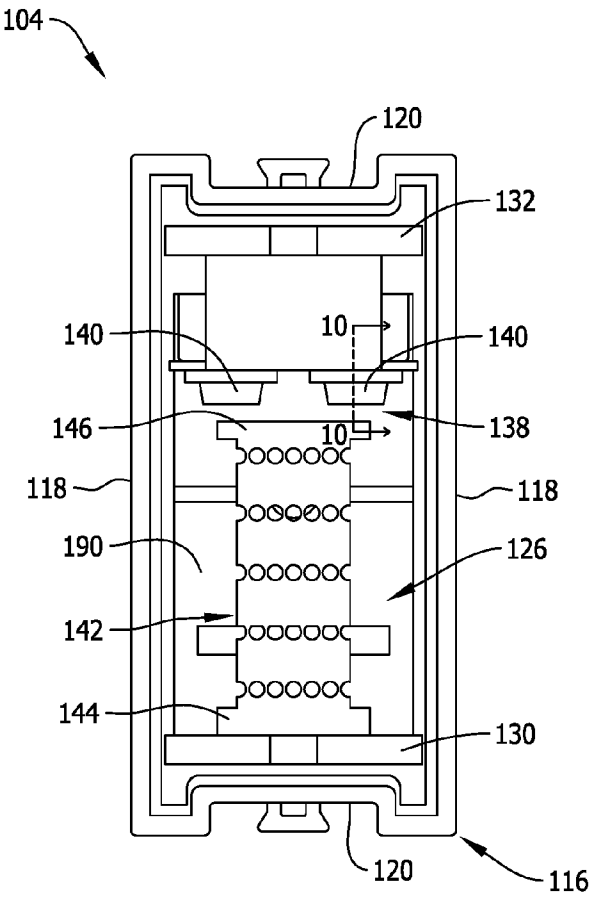
FIG. 4 is a top view of the fuse module shown in FIG. 3.
Figure 5:
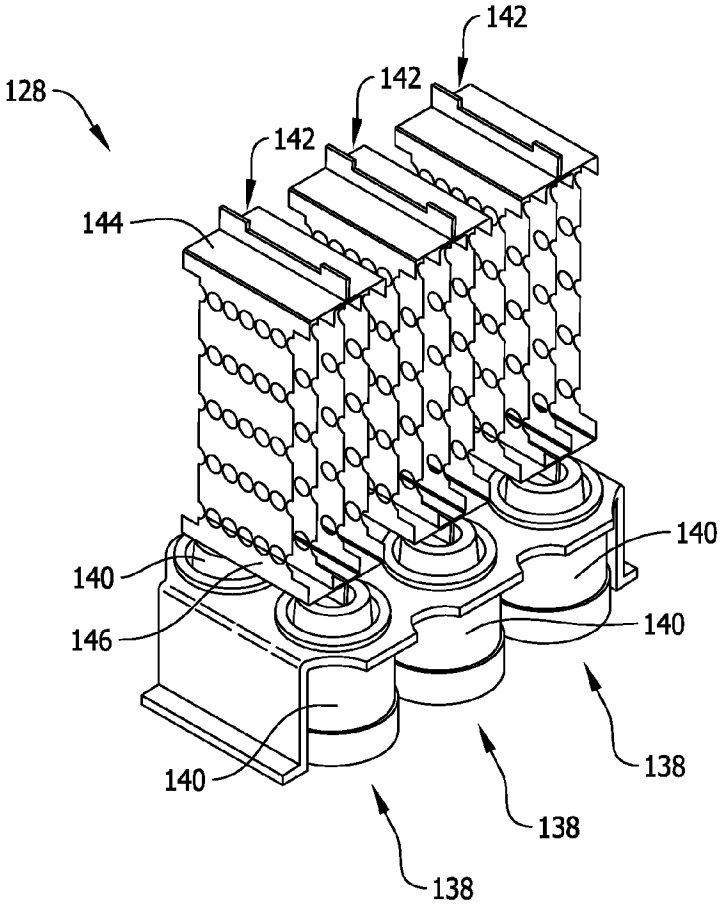
FIG. 5 is a perspective view of a fuse element assembly of the fuse module shown in FIGS. 3 and 4.

With reference to FIG. 1, an embodiment of a fusible disconnect switch assembly 100 is illustrated, and the switch assembly 100 includes a non-conductive switch housing 102 that receives a fuse module 104. The switch assembly 100 is configured for establishing an electrical connection between line side circuitry and load side circuitry through the fuse module 104. By manually pivoting an actuator 106 of the switch assembly 100 between an open position and a closed position, the fuse module 104 and the load side circuitry may be selectively connected to, or disconnected from, the line side circuitry as desired, while the line side circuitry remains "live" in full power operation. In this manner, the switch assembly 100 is useful for electrically isolating the load side circuitry for maintenance, or for removing the fuse module 104 for replacement.

The switch assembly 100 as a whole is rather compact and is sized to occupy less space in an associated fusible panel board assembly, for example, than could otherwise have been accomplished using conventional in-line fuse and circuit breaker combinations. In particular, the fuse module 104 set forth herein occupies a smaller area (sometimes referred to as a footprint) than other types of fuses of comparable rating and interruption capability. With this compact design, the switch assembly 100 and the fuse module 104 facilitate reducing the size of the associated panel board assembly while also providing enhanced interruption capabilities.

The switch housing 102 includes an open ended receptacle 108 sized to receive at least a portion of the fuse module 104 for electrically connecting the fuse module 104 to the line side circuitry and the load side circuitry. In the illustrated embodiment, when the fuse module 104 is installed in the receptacle 108, the fuse module 104 is almost entirely surrounded by the switch housing 102. It is understood, however, that the receptacle 108 may be shallower in other embodiments, such that a smaller portion of the fuse module 104 is surrounded by the switch housing 102. In either configuration, the current-conducting components of the fuse module 104 are physically isolated from the user such that the fuse module 104 is said to be "finger-safe" when inserted into, or removed from, the receptacle 108. In other words, the fuse module 104 may be safely handled during insertion into the receptacle 108 or removal from the receptacle 108 with less risk of electrical shock. By pivoting the actuator 106 into its open position before touching the fuse module 104, however, the risk posed by electrical arcing or energized metal at the fuse module 104 and switch housing 102 interface may be further reduced.

Notwithstanding the size of the receptacle 108 relative to the fuse module 104, the fuse module 104 is configured for easy and safe insertion into, and removal from, the receptacle 108 by hand without tools (e.g., the fuse module 104 may optionally be provided with a selectively deployable handle 110 for ease in gripping the fuse module 104 during removal from the receptacle 108). More specifically, when the fuse module 104 is installed in the receptacle 108, the fuse module 104 projects from the switch housing 102 and is accessible for grasping by hand to pull the fuse module 104 in the direction of the arrow 112 to fully disengage the fuse module 104 from the line side circuitry and load side circuitry, and completely remove the fuse module 104 from the receptacle 108 of the switch housing 102. Likewise, a replacement fuse module 104 may be grasped by hand and inserted into the receptacle 108 of the switch housing 102 in the direction of the arrow 114 to engage the replacement fuse module 104 with the line and load side circuitry. Such plug-in connection and disconnection of the fuse module 104 advantageously facilitates quick and convenient installation and removal of the fuse module 104 without requiring separately supplied fuse carrier elements and without requiring tools or fasteners common to other known disconnect devices. Alternatively, the fuse module 104 and the switch housing 102 may be configured for insertion, installed disposition, and removal of the fuse module 104 in any suitable manner.

While the fuse module 104 may be used in combination with the illustrated switch housing 102 in some embodiments, it should be noted that the manual switching aspects associated with the illustrated switch housing 102 (e.g., the presence of the pivotable actuator 106 inside the switch housing 102) may be considered optional and may be omitted, in which case the switch housing 102 could simply function as a more simplified fuse holder for the fuse module 104. It is understood, however, that even if the switch housing 102 was to be configured as a fuse holder in this manner, the circuit through the fuse holder would still be switchable by mere insertion and removal of the fuse module 104 from the receptacle 108. That is, when used with such a fuse holder, the fuse module 104 would still provide a mode of switching the circuit, and the combination of the fuse holder and the fuse module 104 would nonetheless function in the manner of a disconnect switch. Alternatively, the fuse module 104 may be used in conjunction with any suitable switching mechanism having any suitable mode of operation that is or is not independent from the pluggable switching mode of a more simplified version of the illustrated switch housing 102.

With reference now to FIGS. 2-5, the illustrated fuse module 104 is similar in some respects to the finger-safe, dual-element, time-delay CUBEFuse™ power fuse modules (Catalog Nos. TCF__ or TCF_RN, Datasheet No. 9000) commercially available from Bussmann by Eaton of St. Louis, Mo. However, the illustrated fuse module 104 is adapted for higher current applications that are beyond the capabilities of such previously available CUBEFuse™ power fuse modules. More specifically, the fuse module 104 of the illustrated embodiment is configured for ampacity ratings in excess of 100 A such as, for example, ampacity ratings of 110 A, 200 A, 400 A, 600 A, up to 900 A or more.

The fuse module 104 includes a fuse housing 116 that is sized to provide the fuse module 104 with a more compact footprint that facilitates reducing the overall footprint of the switch assembly 100 set forth above. The fuse housing 116 is fabricated from an electrically nonconductive or insulative material such as, for example, a plastic material. In one particular embodiment, the fuse housing 116 may be fabricated from a thermoplastic material such that the fuse housing 116 exhibits enhanced heat/pressure containment properties at a reduced cost of manufacture as compared to other suitable materials such as ceramic, glass-melamine composite, or thermoset plastic materials.

The fuse housing 116 has a generally hexahedronal (or cube-type) shape. In the illustrated embodiment, for instance, the fuse housing 116 has a substantially rectangular cuboid shape with opposed major side walls 118 and opposed minor side walls 120 interconnecting, and arranged orthogonally with respect to, the major side walls 118. The fuse housing 116 further includes a bottom wall 122 and a top wall 124 such that the walls 118, 120, 122, 124 collectively define a closed cavity 126. Alternatively, the fuse housing 116 may have any suitable arrangement of walls that facilitates enabling the fuse module 104 to function as described herein (e.g., the fuse housing 116 may have a single, annular wall forming a generally cylindrical shape in other embodiments).

The illustrated fuse module 104 further includes a fuse element assembly 128 completely contained within the cavity 126 of the fuse housing 116 and connected between a pair of terminal blades, namely a first terminal blade 130 and a second terminal blade 132. The terminal blades 130, 132 are fabricated from a conductive material, and the terminal blades 130, 132 project from the bottom wall 122 in spaced-apart, generally parallel planes. In this manner, the ends 134 of the terminal blades 130, 132 may be received in pass through openings in the receptacle 108 of the switch housing 102 such that the fuse module 104 may be manually inserted into, or removed from, the receptacle 108 in the manner set forth above. Other suitable arrangements of the terminal blades 130, 132 are also contemplated. For example, one of the terminal blades 130, 132 could be oriented substantially perpendicular to the other, or one of the terminal blades 130, 132 could be staggered or offset relative to the other. Optionally, the fuse module 104 may further include a fuse state indicator 136 disposed on any one or more of the walls 118, 120, 122, 124, and the fuse state indicator 136 may be configured for visually indicating to a person that the fuse module 104 is open and needs replacement.

The fuse element assembly 128 is electrically connected between the terminal blades 130, 132 within the cavity 126 to provide a current path between the terminal blades 130, 132. Notably, the fuse element assembly 128 is designed to melt, disintegrate, or otherwise structurally fail in response to predefined electrical overcurrent conditions and/or short-circuit conditions, thereby permanently opening the current path between the terminal blades 130, 132. When the fuse element assembly 128 opens the current path, the load side circuitry is electrically isolated from the line side circuitry through the fuse module 104 to prevent damage to the load side circuitry and associated componentry. After having opened in this manner, the fuse module 104 must be removed and replaced to restore the electrical connection between the load side circuitry and the line side circuitry through the fuse module 104.

The fuse element assembly 128 includes at least one fuse element unit 138 that is said to be of a "dual-element" configuration in the sense that it includes at least two different types of fuse elements arranged in-series with one another, namely a first type that performs a time-delay overcurrent protection function and a second type that performs a short-circuit protection function. In the illustrated embodiment, each fuse element unit 138 includes a plurality of such overcurrent protection elements (in the form of trigger mechanisms 140) that share one such short-circuit protection element (in the form of a perforated strip 142). In each fuse element unit 138 of the illustrated embodiment, the trigger mechanisms 140 are electrically connected to the second terminal blade 132; and the perforated strip 142 has a first end 144 electrically connected to the first terminal blade 130, and a second end 146 electrically connected to the trigger mechanisms 140. In this manner, each fuse element unit 138 spans from the first terminal blade 130 to the second terminal blade 132 within the cavity 126 to provide the current path between the first terminal blade 130 and the second terminal blade 132.

Figure 6:
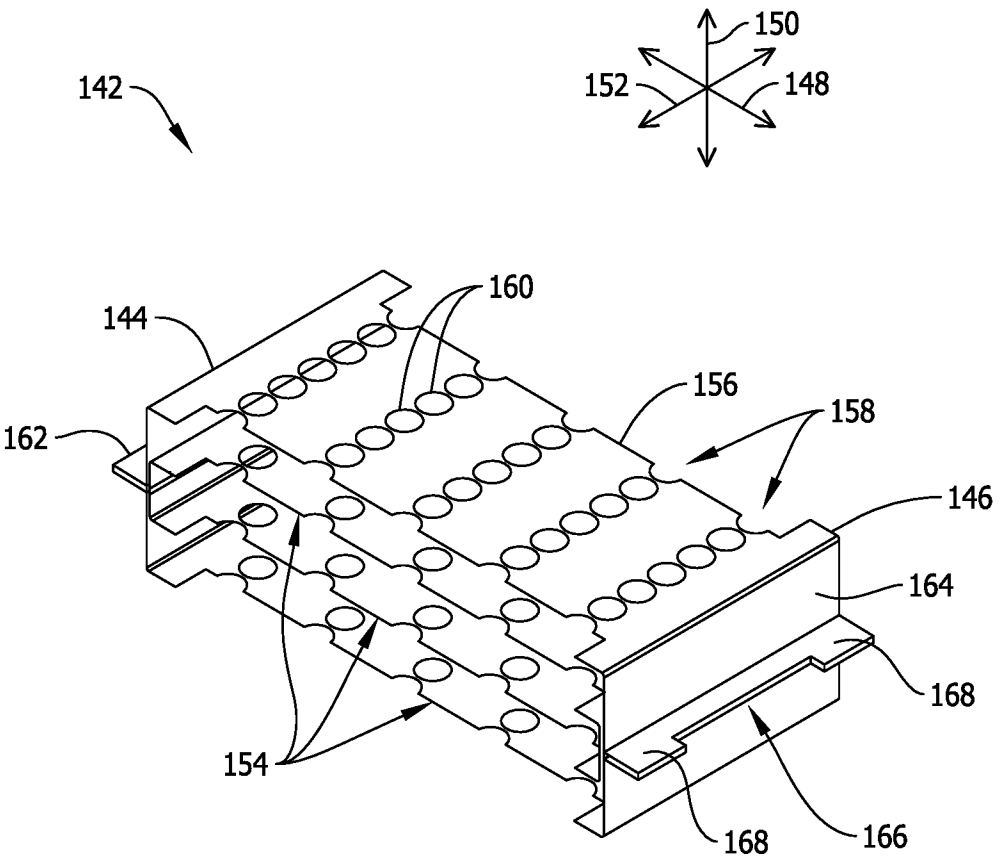
FIG. 6 is a perspective view of a short-circuit element of the fuse element assembly shown in FIG. 5.

With reference to FIG. 6, each perforated strip 142 has a lengthwise dimension 148, a heightwise dimension 150, and a widthwise dimension 152. Each perforated strip 142 includes a plurality of layers 154 extending from the first end 144 to the second end 146 such that the various layers 154 are spaced apart from one another in the heightwise dimension 150. Each of the layers 154 has a body 156 that defines a plurality of linear arrangements 158 of perforations 160, with each linear arrangement 158 extending across the body 156 in the widthwise dimension 152, and with the various linear arrangements 158 being spaced apart from one another along the body 156 in the lengthwise dimension 148. While the perforated strip 142 of the illustrated embodiment has four layers 154, each with five linear arrangements 158 of seven perforations 160, the perforated strip 142 may have any suitable quantity of layers 154, linear arrangements 158 per layer 154, and perforations 160 per linear arrangement 158 in other embodiments (e.g., the perforated strip 142 may only have one layer 154 extending from the first end 144 to the second end 146 in some embodiments).

The first end 144 of the perforated strip 142 has at least one first tab 162 (broadly a first connection point) for electrically connecting the perforated strip 142 to the first terminal blade 130. The second end 146 of the perforated strip 142 has a base wall 164 and a substantially planar (or linearly extending) fin 166 projecting substantially perpendicularly from the base wall 164. The fin 166 defines a plurality of distinct (e.g., spaced-apart) second tabs 168 (broadly second connection points) for electrically connecting the perforated strip 142 to the trigger mechanisms 140 of the respective fuse element unit 138. In this manner, the illustrated fin 166 has a substantially U-shaped profile, with the second tabs 168 essentially forming the legs thereof. Notably, in other embodiments, the second end 146 may have any suitable quantity of second tabs 168 arranged in any suitable manner that facilitates enabling the perforated strip 142 to electrically connect with a desired plurality of trigger mechanisms 140, as set forth in more detail below.

Figure 7:
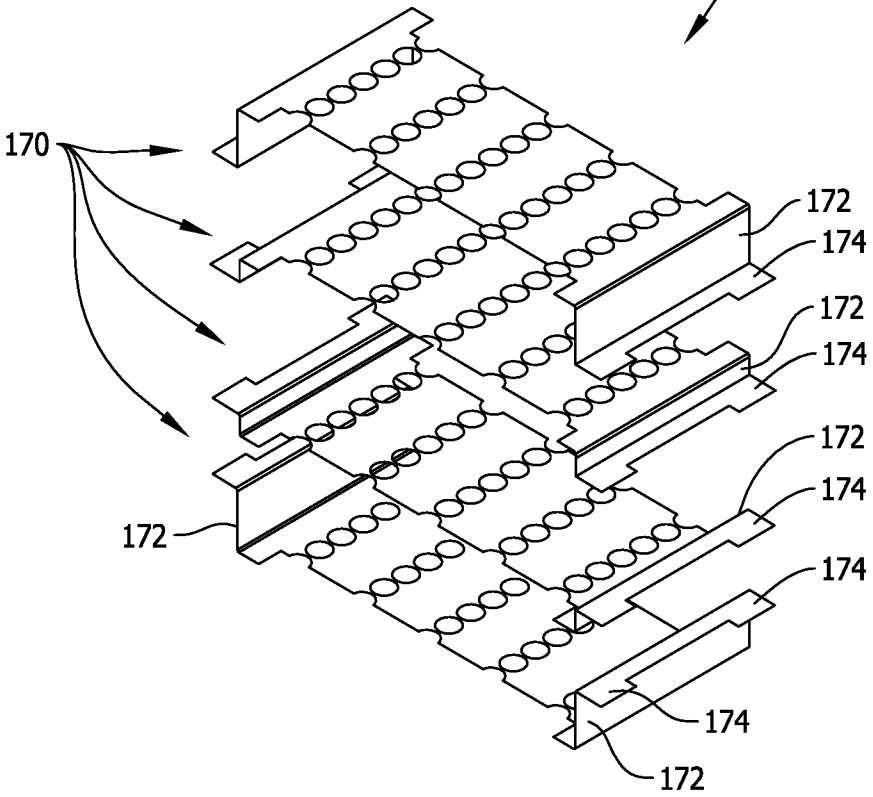
FIG. 7 is an exploded view of the short-circuit element shown in FIG. 6.

As shown in FIG. 7, the perforated strip 142 of the illustrated embodiment is fabricated from a plurality of unconnected (or separate) strip segments 170 that are attached to one another using a suitable attachment method such as soldering, for example. In one embodiment, the strip segments 170 are attached to each other at their respective end portions 172 (e.g., at their respective tab portions 174) to collectively define ends 144, 146 and tabs 162, 168 of the perforated strip 142. In other embodiments, the strip segments 170 may be attached at any suitable location that facilitates enabling the perforated strip 142 to function as described herein.

Figure 8:
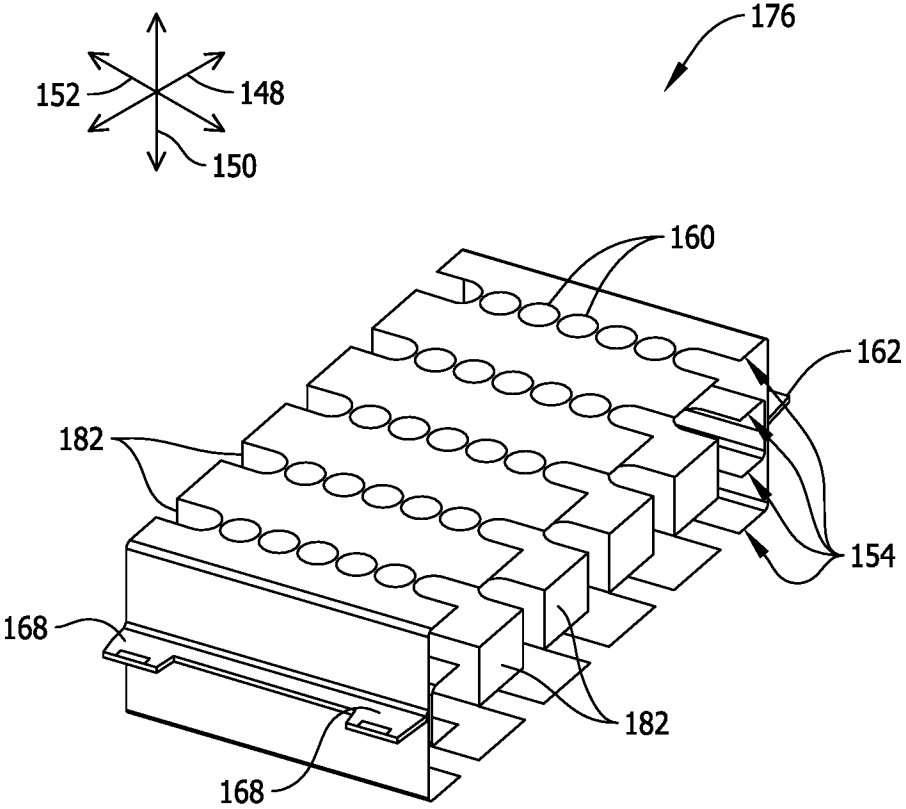
FIG. 8 is another embodiment of a short-circuit element for use in the fuse element assembly shown in FIG. 5.
Figure 9:
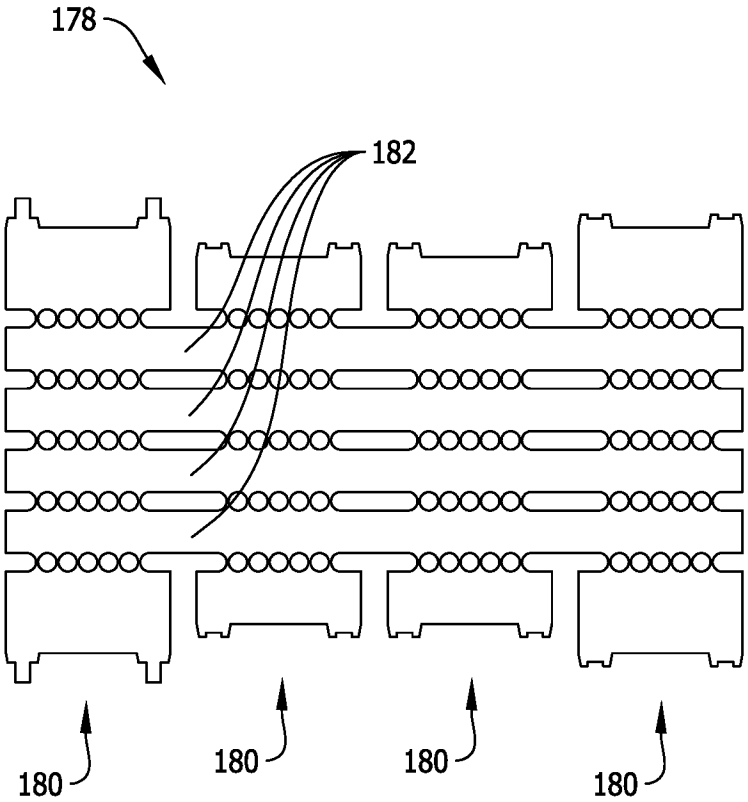
FIG. 9 is a blank for use in fabricating the short-circuit element shown in FIG. 8.

In other embodiments, the perforated strip 142 may be fabricated in any suitable manner. For example, FIGS. 8 and 9 illustrate another embodiment of a perforated strip 176 for use in the fuse element units 138. The perforated strip 176 is similar to the perforated strip 142 set forth above, in that the perforated strips 142, 176 (when fully assembled) have similar lengthwise dimensions 148, heightwise dimensions 150, and widthwise dimensions 152, and in that the perforated strips 142, 176 have similar arrangements of layers 154, perforations 160, and tabs 162, 168. One notable difference between the perforated strip 176 and the perforated strip 142, however, is that the perforated strip 176 is assembled by folding a blank 178 that defines a plurality of laid-flat strip segments 180 that are integrally formed together at a plurality of joints 182, such that the joints 182 connect adjacent ones of the layers 154 when the perforated strip 176 is fully assembled.

Figure 10:
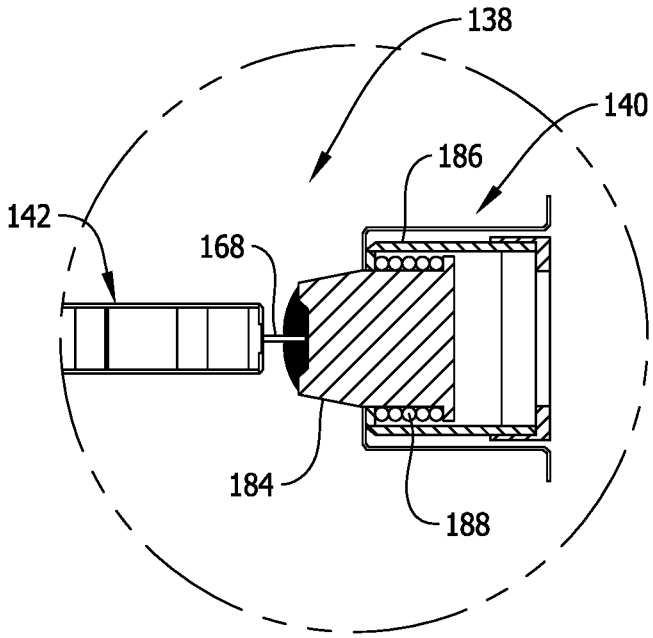
FIG. 10 is a schematic cross-section of a fuse element unit of the fuse element assembly shown in FIG. 5 taken along plane 10-10 of FIG. 5 when the fuse element unit is in a closed state.
Figure 11:
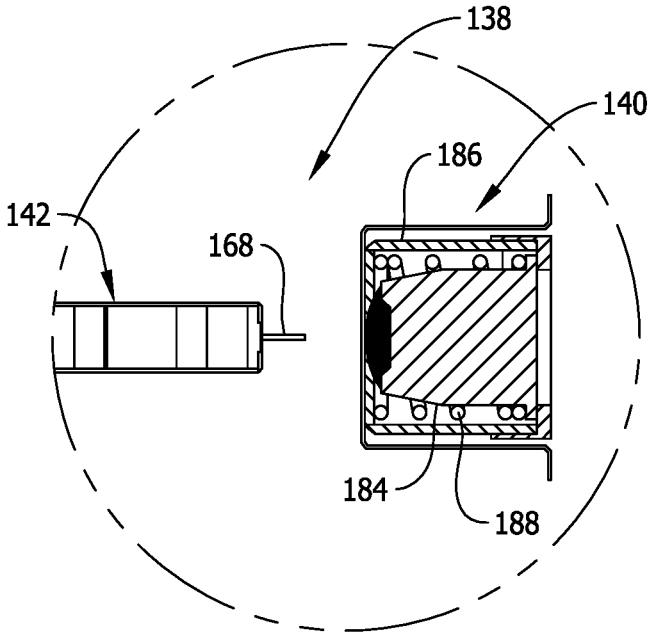
FIG. 11 is a schematic cross-section of the fuse element unit shown in FIG. 10 when the fuse element unit is in an open state.

With reference now to FIGS. 10 and 11, each of the illustrated trigger mechanisms 140 is of the spring-loaded type and includes a trigger 184, a sleeve 186, and spring 188. To establish an electrical connection between the trigger mechanism 140 and its respective perforated strip 142, the trigger 184 projects from the sleeve 186 for suitable attachment to one of the second tabs 168 as shown in FIG. 10. The trigger 184 is held in such position by a suitably located solder connection that effectively opposes the bias (or decompression tendency) of the spring 188. However, upon melting the solder connection that holds the position of the trigger 184 relative the sleeve 186, the spring 188 is permitted to decompress and displace the trigger 184 further into the sleeve 186 as shown in FIG. 11, thereby separating the trigger 184 from the second tab 168 and interrupting the electrical connection between the trigger mechanism 140 and the perforated strip 142 in the process. Notably, the solder connection holding the position of the trigger 184 relative to the sleeve 186 is configured to melt at a predetermined temperature that is indicative of an excessive amount of current flowing through the fuse element unit 138 across the trigger mechanism 140.

To facilitate cost-effective manufacture of the fuse module 104, the illustrated trigger mechanisms 140 in the fuse module 104 are all identical. Furthermore, to facilitate cost-effective manufacture of an entire product line of fuse modules of different ampacities, it is contemplated that the illustrated trigger mechanisms 140 may suitably be incorporated across the entire product line such that all of the fuse modules in the product line utilize identical trigger mechanisms 140 in varying quantities (as used herein, the term "identical" refers to having the same design and being made in the same manner within appropriate manufacturing tolerances).

In that regard, each of the illustrated trigger mechanisms 140 is designed to have an ampacity of 100 A, and the employed quantity of such trigger mechanisms 140 is selectable to suit the desired ampacity rating of a given fuse module. For example, because the illustrated fuse module 104 has an ampacity rating of 600 A, six trigger mechanisms 140 are needed in the fuse module 104 (i.e., 100 A·6=600 A). In one alternative embodiment, if the fuse module 104 had an ampacity rating of 400 A, then only four trigger mechanisms 140 would have been needed in the fuse module 104 (i.e., 100 A·4=400 A). In another alternative embodiment, if the fuse module 104 had an ampacity rating of 900 A, then nine trigger mechanisms 140 would have been needed in the fuse module 104 (i.e., 100 A·9=900 Å). By fabricating only one trigger mechanism 140 for use amongst various fuse modules of different ampacity ratings, many efficiencies of manufacture may be realized. In other embodiments, identical trigger mechanisms may not be incorporated across fuse modules of different ampacity ratings, such that each different fuse module may have any suitable number of trigger mechanisms each uniquely designed to suit its specific application.

Referring back to FIGS. 4 and 5, the illustrated fuse module 104 is adapted for higher current applications that are beyond the capabilities of previously available cube-type power fuse modules. More specifically, the fuse module 104 of the illustrated embodiment is configured for ampacity ratings in excess of 100 A such as, for example, ampacity ratings of 110 A, 200 A, 400 A, 600 A, up to 900 A or more.

Aside from providing the fuse module 104 with a higher ampacity rating, it is also desirable to provide the fuse module 104 with a relatively compact footprint. Yet, the desire to increase the ampacity and the desire to decrease the footprint tend to be competing interests. In fact, to achieve a higher ampacity rating, it is often necessary to provide more (or larger) trigger mechanisms and/or more (or larger) perforated strips. Such an increase in the size of the fuse element assembly tends to increase the space occupied by the fuse element assembly which, in turn, causes the fuse housing to be sized larger. This is true even more so when considering that the spacing between the fuse element assembly and the walls of the fuse housing should be made large enough to provide the fuse housing with optimal temperature/pressure containment capabilities, and the disposition of the fuse element assembly within the fuse housing may influence such spacing. In other words, the spacing between the fuse element assembly and the walls of the fuse housing may influence the ability of the fuse housing to contain the temperature and pressure increases that accompany an interruption of the current path through the fuse element assembly (i.e., the temperature and pressure increases that accompany a higher current, higher voltage arcing event). That said, it is nonetheless desirable to fabricate the fuse module in a cost-effective manner.

The fuse module 104 has been designed with all of these considerations in mind (i.e., to provide for optimal performance, reduced size, and cost-effective manufacture). The fuse housing 116 is made smaller (e.g., with less cavity volume and thinner walls 118, 120, 122, 124) and is fabricated from a high-performance, cost-effective material, such as a thermoplastic material. Also, because the trigger mechanisms 140 are configured for incorporation into fuse modules of various different ampacity ratings, cost savings are realized due to the repeatable manufacture and use of the trigger mechanisms 140 across an entire product line of fuse modules. Such design considerations are encouraged by the fact that the size of the fuse element assembly 128 has been made more compact, in that the fuse element assembly 128 is configured to permit a greater quantity of trigger mechanisms 140 and a greater quantity of perforated strips 142 to occupy a smaller space. More specifically, because each perforated strip 142 is electrically connected in series to more than one trigger mechanism 140, the overall quantity of fuse element units 138 has been reduced in each fuse module without sacrificing ampacity. In the illustrated embodiment for example, rather than achieving the 600 A rating of the fuse module 104 by providing six fuse element units each with one trigger mechanism and one perforated strip, the fuse module 104 has instead been provided with three fuse element units 138 each having two trigger mechanisms 140 and one perforated strip 142. Thus, the fuse element assembly 128 is able to be made using less fuse element units for a given ampacity rating, thereby decreasing its size and enabling it to be manufactured in less time using fewer raw materials, fewer fixtures, and less energy (e.g., heat), for example.

By providing more than one trigger mechanism 140 per fuse element unit 138, the space occupied by the fuse element assembly 128 as a whole is reduced. In particular, the margin 190 (shown in FIG. 4) between the perforations 160 and the major side walls 118 of the fuse housing 116 is increased. For example, in the illustrated embodiment, the margin 190 is about 10.2 mm between the perforations 160 and the major side walls 118 of the fuse housing 116. In this manner, the fuse element assembly 128 is configured to have a higher energy density in the event of an interruption along the current path across one or more of the layers 154 (e.g., in the event of electrical arc(s) being struck across the perforations 160). This higher energy density assists the more cost-effective fuse housing 116 in better withstanding the increases in temperature and pressure that accompany such an interruption. In other embodiments, the fuse element assembly 128 (e.g., the perforations 160) and the major side walls 118 of the fuse housing 116 may be separated by any suitable margin that facilitates enabling the fuse module 104 to function as described herein.

In light of the embodiments described herein, the number of trigger mechanisms per perforated strip may be selected to better suit a desired fuse housing shape. More specifically, any suitable quantity of trigger mechanisms may be arranged in any suitable matrix and joined together in any suitable combination(s) by any suitable quantity of perforated strips. For example, when designing a 600 A fuse module, the associated fuse element assembly could be arranged in any of the following ways: (i) the fuse element assembly could have two fuse element units each with three trigger mechanisms per perforated strip; (ii) the fuse element assembly could have three fuse element units each with two trigger mechanisms per perforated strip (as in the embodiment described above); (iii) the fuse element assembly could have one fuse element unit with six trigger mechanisms on one perforated strip; (iv) the fuse element assembly could have two fuse element units, wherein one of the units has four trigger mechanisms on one perforated strip, and the other of the units has two trigger mechanisms on one perforated strip; or (v) the fuse element assembly could have two fuse element units, wherein one of the units has five trigger mechanisms on one perforated strip, and the other of the units has one trigger mechanism on one perforated strip. Because the size of the fuse housing could be shaped differently for each of these options, the fuse element assembly embodiments described herein provide increased flexibility in designing the size (or footprint) of a fuse module and, therefore, the size (or footprint) of a fusible disconnect switch assembly without sacrificing the performance capability of the fuse module.

The benefits of the inventive concepts described are now believed to have been amply illustrated in relation to the exemplary embodiments disclosed.

An embodiment of a fuse module has been disclosed. The fuse module includes a housing and a fuse element assembly contained within the housing. The fuse element assembly includes a fuse element unit having a plurality of trigger mechanisms and a perforated strip electrically connected to the trigger mechanisms.

Optionally, the fuse element assembly may include a plurality of the fuse element units arranged to be electrically in parallel with one another. The perforated strip may have an end and a plurality of tabs disposed at the end such that each of the tabs electrically connects the perforated strip to one of the trigger mechanisms. The perforated strip may also have a plurality of spaced-apart layers. Furthermore, each of the trigger mechanisms may include a spring-loaded trigger. The housing may have a substantially rectangular cuboid shape. Also, the housing may be a thermoplastic housing.

An embodiment of a fuse element has also been disclosed. The fuse element has a first end, a second end, and a perforated body extending between the first end and the second end. One of the ends has a plurality of distinct connection points.

Optionally, the connection points may be spaced apart from one another. Also, the connection points may be tabs. The one of the ends may have a substantially linearly extending fin such that the tabs are defined on the fin. Additionally, the one of the ends may have a base wall such that the fin extends substantially perpendicularly from the base wall. Furthermore, the fuse element may have a plurality of spaced-apart layers, one of which includes the body. The plurality of spaced apart layers may be integrally formed together such that adjacent ones of the layers are connected together by a plurality of joints.

An embodiment of a fusible disconnect switch assembly is also disclosed. The fusible disconnect switch assembly includes a switch housing having a receptacle. The fusible disconnect switch assembly also includes a time-delay fuse module configured for removable insertion into the receptacle, wherein the fuse module includes a generally hexahedronal fuse housing and has an ampacity rating of greater than 100 A.

Optionally, the switch assembly may have a pivotable actuator disposed at least in part within the switch housing and configured for electrically isolating load side circuitry from line side circuitry by manual pivoting of the actuator. Also, the fuse module may be a dual-element fuse module. Furthermore, the fuse housing may be configured to render the fuse module finger-safe. The fuse module may have a fuse element assembly contained within the fuse housing, wherein the fuse element assembly has a fuse element unit having a plurality of trigger mechanisms and a perforated strip electrically connected to the trigger mechanisms. Additionally, each of the trigger mechanisms may have a spring-loaded trigger.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fuse element for containment in a generally hexahedronal housing of a time-delay fuse module, the fuse element comprising:

a first end;

a second end; and a multi-layer perforated body extending between the first end and the second end, wherein both of the first end and the second end have a plurality of distinct connection points, and wherein the fuse element has an ampacity rating of greater than 100 A.

2. The fuse element of claim 1, wherein the plurality of distinct connection points are spaced apart from one another.

3. The fuse element of claim 2, wherein the plurality of distinct connection points comprises a plurality of tabs.

4. The fuse element of claim 3, wherein one of the first and second ends has a substantially linearly extending fin such that the plurality of tabs are defined on the fin.

5. The fuse element of claim 4, wherein the one of the first and second ends has a base wall, and wherein the substantially linearly extending fin extends substantially perpendicularly from the base wall.

6. The fuse element of claim 1, wherein the multi-layer perforated body includes at least four perforated layers spaced apart from another.

7. The fuse element of claim 1, wherein multi-layer perforated body is integrally formed with the plurality of distinct connection points.

8. A fusible disconnect switch assembly comprising:

a switch housing having a receptacle; and a time-delay fuse module removably insertable into the receptacle, wherein the time-delay fuse module includes a fuse housing, and a plurality of multi-layer fuse elements electrically connected in parallel within the fuse housing, wherein the time-delay fuse module has an ampacity rating of greater than 100 A.

9. The fusible disconnect switch assembly of claim 8, wherein the switch assembly includes a pivotable actuator disposed at least in part within the switch housing for electrically isolating load side circuitry from line side circuitry by manual pivoting of the actuator.

10. The fusible disconnect switch assembly of claim 8, wherein the fuse housing facilitates finger-safe handling of the time-delay fuse module.

11. The fusible disconnect switch assembly of claim 8, further comprising a plurality of trigger mechanisms electrically connected to the multi-layer fuse element, the multi-layer fuse element including a plurality of perforated strips.

12. The fusible disconnect switch assembly of claim 11, wherein each of the trigger mechanisms comprises a spring-loaded trigger.

13. A time-delay fuse module comprising:

a housing; and a short circuit protection multi-layer fuse element contained within the housing and having an ampacity rating of greater than 100 A, wherein the short circuit protection multi-layer fuse element includes a plurality of perforated strips spaced apart from one another, each of the perforated strips including a first end and a second end each having a plurality of distinct connection points.

14. The time-delay fuse module of claim 13, wherein the housing has a substantially rectangular cuboid shape.

15. The time-delay fuse module of claim 13, wherein the housing is fabricated from a thermoplastic material.

16. The time-delay fuse module of claim 13, wherein the housing is not fabricated from a ceramic material, a glass-melamine composite material, or a thermoset plastic material.

17. The time-delay fuse module of claim 13, further comprising a plurality of time-delay overcurrent protection trigger mechanisms electrically connected to the multi-layer fuse element.

18. The time-delay fuse module of claim 17, wherein each of the plurality of time-delay overcurrent protection trigger mechanisms is connected to the multi-layer fuse element at a different one of the connection points.

* * * * *